US006343576B1

(12) United States Patent
Ogata et al.

(10) Patent No.: US 6,343,576 B1
(45) Date of Patent: Feb. 5, 2002

(54) OVERHEAD CAMSHAFT V-2 ENGINE

(75) Inventors: Fumio Ogata; Makoto Yonezawa; Takashi Suzuki; Hiroshi Moriyama; Akihisa Shinoda, all of Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/687,885

(22) Filed: Oct. 13, 2000

(30) Foreign Application Priority Data

Oct. 15, 1999 (JP) ..... 11-294490
Oct. 19, 1999 (JP) ..... 11-297481

(51) Int. Cl.[7] ..... F01M 9/10; F02F 1/20
(52) U.S. Cl. ..... 123/54.4; 123/184.31
(58) Field of Search ..... 123/54.4, 184.31, 123/184.34, 196 R, 196 M

(56) References Cited

U.S. PATENT DOCUMENTS 4,793,300 A * 12/1988 Kadoshima et al. .... 123/195 A
5,438,963 A * 8/1995 Tsunoda et al. ..... 123/54.4
5,564,380 A * 10/1996 Kobayashi et al. ..... 123/54.4
5,673,655 A * 10/1997 Mishima ..... 123/54.4
6,213,072 B1 * 4/2001 Sayama et al. ..... 123/54.4

* cited by examiner

*Primary Examiner*—Marguerite McMahon
(74) *Attorney, Agent, or Firm*—Adams & Wilks

(57) ABSTRACT

An overhead camshaft V-2 engine includes a single power transmitting mechanism disposed on one side of a crankcase for transmitting rotational power from a crankshaft to respective camshafts of drive valve mechanisms. The power transmitting mechanism has a driving member mounted to only one end portion of the crankshaft. The thus arranged power transmitting mechanism enables downsizing of the engine. Two intake ports are formed in respective cylinder heads of two cylinder blocks and open at one end to respective first surfaces of the cylinder heads facing in a first direction, and two exhaust ports are formed in the respective cylinder heads of the cylinder blocks and open at one end to respective second surfaces of the cylinder heads facing in a second direction opposite to the first direction. With this arrangement of the intake and exhaust ports, intake pipes can be arranged with a high degree of freedom.

9 Claims, 7 Drawing Sheets

OVERHEAD CAMSHAFT V-2 ENGINE

BACKGROUND OF THE INVENTION

1. Field of the Invention

This invention relates to an improvement in a two-cylinder V-type spark-ignition engine with overhead camshafts, generally called an overhead (OHC) V-2 engine.

2. Description of the Related Art

Various OHC V-2 engines are known and one example of such known OHC V-2 engines is disclosed in Japanese Patent Laid-open Publication No. SHO-58-167875. The disclosed engine has two cylinders mounted to a crankcase such that the cylinders are arranged at an angle to each other in the longitudinal direction of a vehicle body on which the engine is installed. The engine also has a valve mechanism having a camshaft mounted in a cylinder head of each cylinder. The cylinder head is bolted to an upper end of a cylinder block to thereby form a single cylinder Each of the cylinders has an intake port and an exhaust port. The intake port opens to one surface of the cylinder which faces toward another cylinder, and the exhaust port opens to the opposite surface of the cylinder which faces away from another cylinder. With this arrangement of the intake and exhaust ports, two intake pipes connected at one end to the respective intake ports and carburetors associated with the respective intake pipes are all disposed in a relatively small space defined between the two cylinders. This poses a limited degree of freedom in arranging the intake pipes, tending to hinder uniform and efficient supply of fresh air to the cylinders.

Furthermore, in the conventional OHC V-2 engine, since a power transmitting mechanism for transmitting power from a crankshaft to the camshaft of each cylinder for driving the latter is disposed on both left and right sides of the crankcase adjacent to opposite longitudinal ends of the crankshaft, the overall width and weight of the engine are relatively large. In addition, due to the aforesaid arrangement, the power transmitting mechanisms require the engine to be turned through an angle of 180° during assembly or maintenance of the power transmitting mechanisms. This may lower the productivity of the engine.

Furthermore, since the crankcase has a partition wall disposed between a driving gear of each power transmitting mechanism and an adjacent connecting rod of the crankshaft, the width of the crankcase is relatively large. In addition, the power transmitting mechanisms are of the two-stage transmission type including an intermediate shaft carrying thereon a first intermediate gear held in mesh with a driving gear attached to the crankcase and a second intermediate gear connected by a chain to a driven gear attach to each of the camshafts. The power transmitting mechanisms are relatively large in size, require a relatively large number of components, are expensive to manufacture, and enlarge the overall size of the engine.

SUMMARY OF THE INVENTION

It is accordingly an object of the present invention to provide an overhead camshaft V-2 engine having structural features which enable downsizing of the engine, provide an increased degree of freedom in arranging intake pipes, facilitate easy assembly and maintenance of the engine, and enable efficient lubrication of valve mechanisms with a compact lubricating mechanism.

According to the present invention, there is provided an overhead camshaft V-2 engine comprising: a crankcase; a crankshaft rotatably supported in the crankcase; two cylinder blocks each having one cylinder head and mounted to the crankcase such that the cylinder blocks are arranged at an angle to each other; two valve mechanisms each mounted to the cylinder head of one of the cylinder blocks and having one camshaft; a single power transmitting mechanism disposed on one side of the crankcase for transmitting rotational power from the crankshaft to the camshafts to drive the valve mechanisms, the power transmitting mechanism having a driving member mounted to only one end portion of the crankshaft; and two intake ports formed in the respective cylinder heads of the cylinder blocks and opening at one end to respective first surfaces of the cylinder heads facing in a first direction, and two exhaust ports formed in the respective cylinder heads of the cylinder blocks and opening at one end to respective second surfaces of the cylinder heads facing in a second direction opposite to the first direction. The engine may further include a cooling fan mounted to the opposite end portion of the crankshaft.

The power transmitting mechanism thus arranged occupies only a relatively small space for installation and hence can reduce the overall size of the engine. In addition, the foregoing arrangement of the intake and exhaust ports enables intake pipes to be arranged with a high degree of freedom.

In one preferred form of the invention, the driving member of the power transmitting mechanism includes a pair of driving pulleys mounted in tandem on the crankshaft. It is preferable that the pitch or distance between the pair of driving pulleys is substantially equal to the pitch or distance between two connecting rods attached side by side to a single offset crankpin of the crankshaft.

The power transmitting mechanism may further comprise a pair of driven pulleys connected to the respective camshafts of the valve mechanisms, and a pair of driving belts each trained around one of the driving pulleys and a corresponding one of the driven pulleys.

Preferably, the crankshaft has a boss of an enlarged diameter held in abutment with an end face of one of the driving pulleys and slidably engageable with an outside edge of one of the driving belts for guiding the one driving belt, and the engine further has a ring-like belt guide mounted on the crankshaft and disposed between an end face of the other driving pulley and a portion of the crankcase, the belt guide being slidably engageable with an outside edge of the other driving belt for guiding the other belt.

The overhead camshaft V-2 engine may further comprise a centrifugal governor mechanism disposed in the crankcase for controlling rotational speed of the engine, and a lubricating mechanism for lubricating movable parts of the engine. The governor mechanism preferably has a generally cup-shaped holder rotatably driven by the crankshaft and being partly dipped below a lubricating oil held at a bottom of the crankcase. The lubricating mechanism preferably has a plurality of circumferentially spaced oil splashing projections formed on an outer peripheral surface of the cup-shaped holder so that when the cup-shaped holder is rotating by the rotational power of the crankshaft, the oil splashing projections continuously revolve about an axis of rotation of the cup-shaped holder to thereby draw up the lubricating oil from the bottom of the crankcase and splash the lubricating oil over at least a part of the power transmitting mechanism. The driving chains of the power transmitting mechanism form part of the lubricating mechanism and is capable of guiding the lubricating oil into the valve mechanisms. The governor mechanism may further have a driving gear formed integrally with the driving member and disposed between the pair of driving pulleys, the driving gear being connected in driving relation to the cup-shaped holder for rotating the holder.

The above and other object, features and advantages of the present invention will become manifest to those versed in the art upon making reference to the following description and accompanying sheets of drawings in which preferred structural embodiments incorporating the principles of the invention are shown by way of illustrative examples.

DETAILED DESCRIPTION OF THE PREFERRED EMBODIMENT

The following description is merely exemplary in nature and is in no way intended to limit the invention or its application or use.

Figure 1:
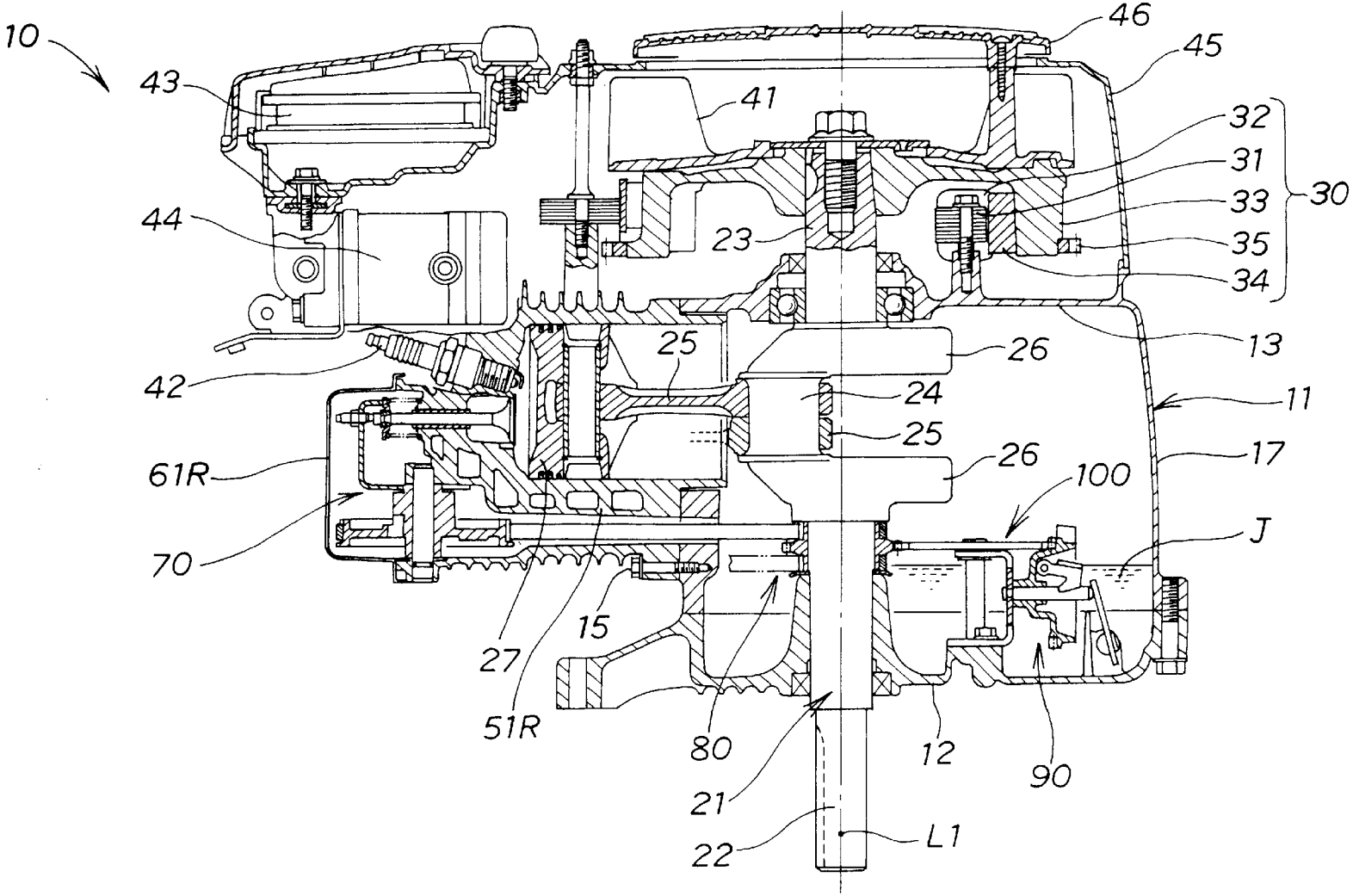
FIG. 1 is a vertical cross-sectional view of an OHC V-2 engine according to an embodiment of the present invention.

Referring to FIG. 1, there is shown an OHC V-2 engine according to an embodiment of the present invention. As shown the engine 10 is a flat type in which cylinder blocks 51R (only one being shown) are laid horizontally and a crankshaft 21 extends vertically.

The flat OHC V-2 engine 10 includes a crankcase 11 of a generally inverted cup-shaped configuration having an open end facing downward, and a lid 12 attached by screws (only one being shown) to the crankshaft 11 so as to close the openi end of the crankcase 11. The crankcase 21 is rotatably mounted in the crankcase 11 and has longitudinal opposite end portions 22, 23 journaled on the crankcase 11 and the lid 12, respectively, via a pair of bearings (not designated). The lower end portion 22 of the crankshaft 21 projects downward from the lid 11 and forms a power take out portion of the engine 10. The upper end portion 23 projects upward from an upper wall 13 of the crankcase 11 for a purpose described below.

The crankshaft 21 has a longitudinal central portion forming a single offset journal or crankpin 24 to which two connecting rods 25 and 26 are attached side-by-side.

The engine 10 is equipped with an alternator 30 and a cooling fan 41 disposed above the crankcase 11.

The alternator 30 is an outer rotor type multi-pole magnetoelectric generator and has an outer rotor 33 attached to the upper end portion 23 of the crankshaft 21. The alternator 30 also has an inner stator frame 31 mounted to the upper wall 13 of the crankcase 11, stator windings 32 wound on the stator frame 31, and a permanent magnet 34 attached to an inner circumferential surface of the outer rotor 33. The outer rotor 33 has a driven ring gear 35 formed on an outer circumferential surface thereof and adapted to be driven by a driving gear (not shown) of a starting motor (not shown).

The cooling fan 41 is attached to the upper end portion 23 of the crankshaft 21 for co-rotation with the crankshaft 21 to cool the engine 10. The cooling fan 41 is disposed on an upper side of the outer rotor 33 of the alternator 30.

Thus, the outer rotor 33 of the alternator 30 and the cooling fan 41 are attached to one end (upper end portion 23) of the crankshaft 21 for co-rotation therewith, and the other end (lower end portion 22) of the crankshaft 21 forms the power take out portion of the engine 10.

In FIG. 1, reference numerals 26, 26 denote crank webs of the crankshaft 21. Similarly, reference numerals 42, 43 and 44 denote an ignition plug, an air-cleaner, and a carburetor of the engine 10, respectively. Reference numeral 45 denotes an alternator case in which the alternator 30 is housed, and reference numeral 46 is a cover located above an upper opening (not designated) of the alternator case 45.

Figure 2:
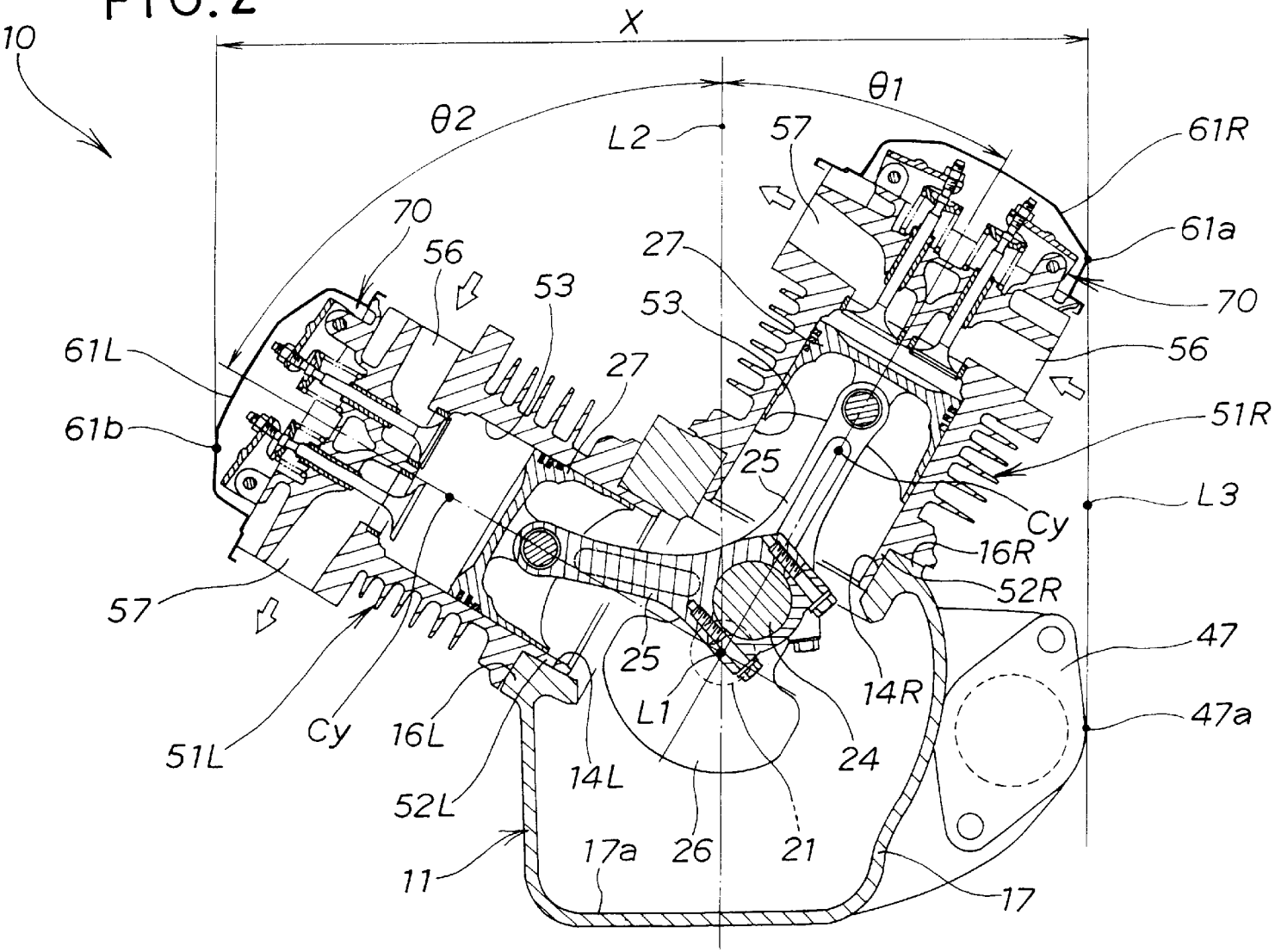
FIG. 2 is a horizontal cross-sectional view of the OHC V-2 engine.

As shown in FIG. 2, the engine 10 further has two cylinder blocks 51L, 51R attached by screws 15 (one being shown in FIG. 1) to the crankcase 11 so that they are arranged at an angle to each other about the axis L1 of the crankshaft 21. The cylinder blocks 51L, 51R have a mounting end 52L, 52R fitted in each of two mounting holes 14L, 14R formed in a sidewall 17 of the crankcase 11. The angle between the cylinder blocks 51L, 51R, that is, the bank angle is approximately 90 degrees. The screws 15 (FIG. 1) may be replaced by stud bolts and nuts used in combination.

The cylinder blocks 51L, 51R are each provided with a multiplicity of cooling fins (not designated). An endmost one of the cooling fins is located near the bottom dead center of a piston 27, 27 slidably received in the corresponding cylinder block 51L, 51R, and a mating surface of each cylinder block 51L, 51R relative to the crankcase 11 is preferably set to be positioned near the endmost cooling fin. The cylinder blocks 51L, 51R are offset from each other in the axial direction of the crankshaft 21 so that the connecting rods 25, 25 can be disposed side by side on the single crankpin 24.

The sidewall 17 of the crankcase 11 includes a generally flat portion 17*a* opposite to the mounting holes 14L, 14R. The crankcase 11 has a centerline L2 which is orthogonal to the flat sidewall portion 17*a* and extends perpendicularly through the axis L1 of the crankshaft 12. In FIG. 2, a starter motor 47 serving as an auxiliary device of the engine 10 is disposed on a right-hand side of the crankcase 11 when viewed from the centerline L2 of the crankcase 11.

The bank angle ($\theta 1+\theta 2$) between the cylinder blocks 51L, 51R is approximately 90 degrees, as previously described. The angular position of the respective cylinder axes Cy, Cy of the cylinder blocks 51L, 51R relative to the axis L1 of the crankshaft 21 is determined such that a straight line L3 circumscribing an outer end portion 47*a* (right-hand end in FIG. 2) of the starter motor 47 and an outer end portion 61*a* (right-hand end in FIG. 2) of a head cover 61R attached to the cylinder block 51R is in parallel to the centerline L2 of the crankcase 11. Thus, in a horizontal plane, the cylinder axis Cy of the cylinder head 51R is circumferentially spaced from the centerline L2 of the crankcase 11 by an angle $\theta 1$ which is smaller than the angle $\theta 2$ between the cylinder axis Cy of the cylinder head 51L and the centerline L2 of the crankcase 11. A maximum width X of the engine 10 is equal to the distance between the right-hand end 61*a* of the head cover 61R and the left-hand end 61*b* of a head cover 61L attached to the cylinder block 51L.

Figure 3:
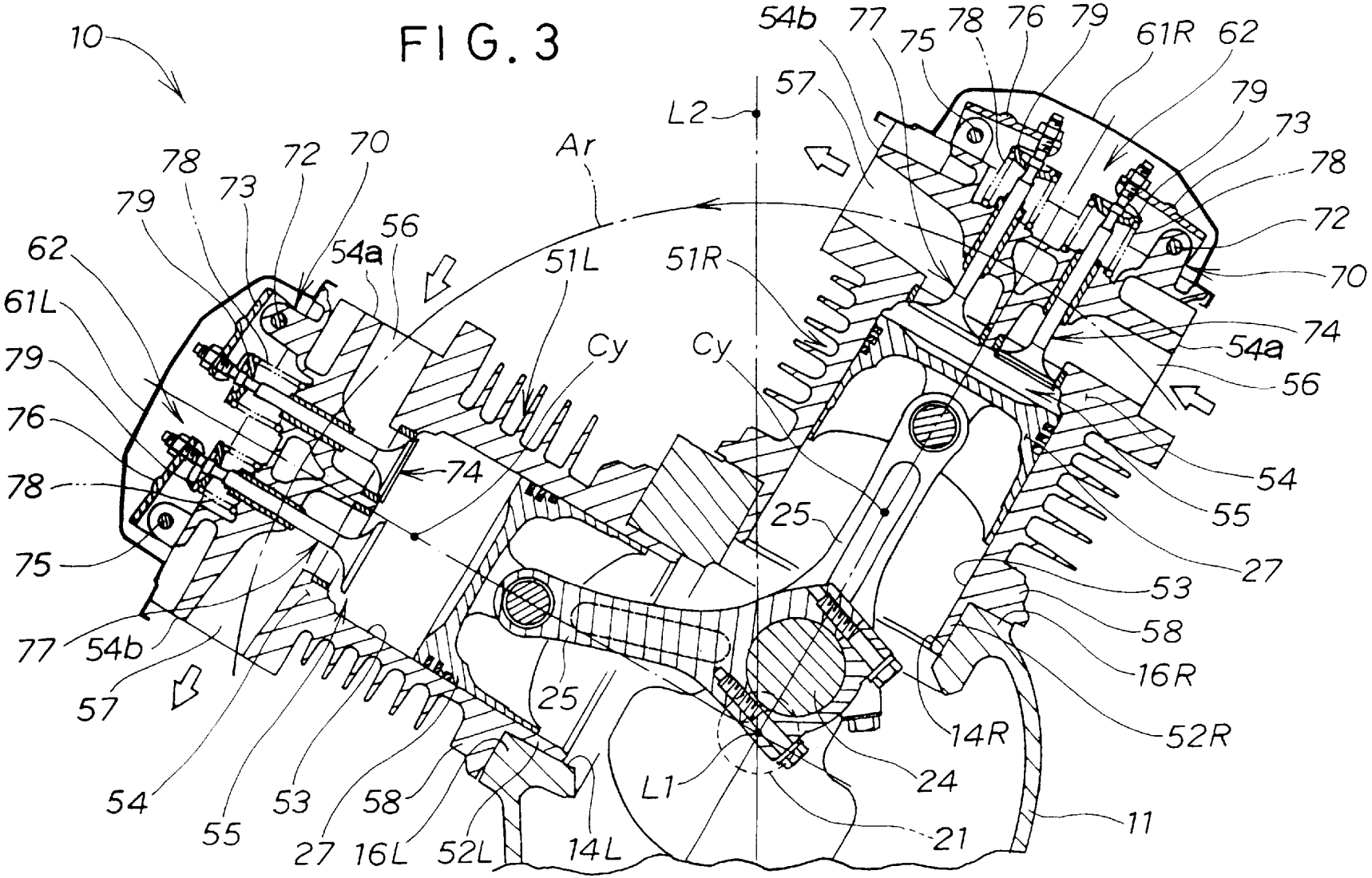
FIG. 3 is an enlarged view of a portion of FIG. 2.

Reference is next made to FIG. 3 which is an enlarged view of a portion of FIG. 2. As shown in this figure, the left cylinder block 51L and related parts thereof are identical in construction to the right cylinder block 51R and related parts thereof. Accordingly, the same reference characters are used in designating the like or corresponding parts, and a description given below will be limited to only one cylinder block (right cylinder block 51R in the illustrated embodiment) and related parts thereof.

The cylinder block 51R is of the so-called "unitary block" type and includes a cylinder 53 formed therein along the cylinder axis Cy, and a cylinder head 54 formed integrally with an upper part of the cylinder block 51R to cover the cylinder 53. The piston 27 is slidably fitted in the cylinder 53 for reciprocation along the cylinder axis Cy, there being a combustion chamber 55 defined between the top of the piston 27 and the cylinder head 54. The cylinder head 54 has an intake port 56 and an exhaust port 57 formed therein in diametrically opposed relation to one another. The piston 27 is connected by the connecting rod 25 to the crankpin 24 of the crankshaft 21 so that when the piston 25 slides up and down along the cylinder 53, the crankshaft 21 is forced to rotate by the piston 27 through the connecting rod 25.

The head cover 61R is attached by screws (not shown) to the top of the cylinder head 54 so as to define therebetween a valve chamber 62 in which a valve mechanism 70 is disposed.

The valve mechanism 70 is mounted to the cylinder head 54 and essentially has a camshaft 71 (FIG. 5), an intake valve 74, a rocker shaft 72 for the intake valve 74, a rocker arm 73 for the intake valve 74, an exhaust valve 77, a rocker shaft 75 for the exhaust valve 77, and a rocker arm 76 of the exhaust valve 77.

The cylinder heads 54 have one surface 54*a* facing rightward in FIG. 3 and the opposite surface 54*b* facing leftward in FIG. 3. The intake ports 56 are directed in the same direction and have one end opening to the one surface 54*a* of the cylinder head 54. The exhaust ports 56 are directed in the same direction and have one end opening to the opposite surface 54*b* of the cylinder head 54.

In other words, the left and right cylinder blocks 51L, 51R of the same construction are oriented in the same direction so that the intake port 56 of the right cylinder head 54, the exhaust port 57 of the right cylinder head 54, the intake port 56 of the left cylinder head 54 and the exhaust port 57 of the left cylinder head 54 are arranged in the order named when viewed in the counterclockwise direction along an arc Ar drawn about the axis L1 of the crankcase 21.

With this arrangement, a space available for installation of the intake pipes is enlarged with the result that the intake pipes can be arranged with a high degree of freedom. In addition, since the left and right cylinder blocks 51L, 51R are oriented in the same direction with respect to the crankcase 11, mis-orientation is unlikely to occur when they are assembled to the crankcase 11.

As previously described, the left cylinder block 51L and its related parts including the connecting rod 25, piston 27, cylinder head 54, head cover 61 and valve mechanism 70 are identical in construction to the right cylinder block 51R and associated parts 25, 27, 61 and 70 thereof. Since many parts can thus be used in common, it is possible to increase the productivity and lower the equipment cost. Eventually, the OHC V-2 engine 10 can be manufactured at a relatively low cost.

In FIG. 3, numeral 78 denotes a valve spring associated with each valve 76, 77, and numeral 79 is a retainer for retaining one end of the valve spring 78.

Figure 4:
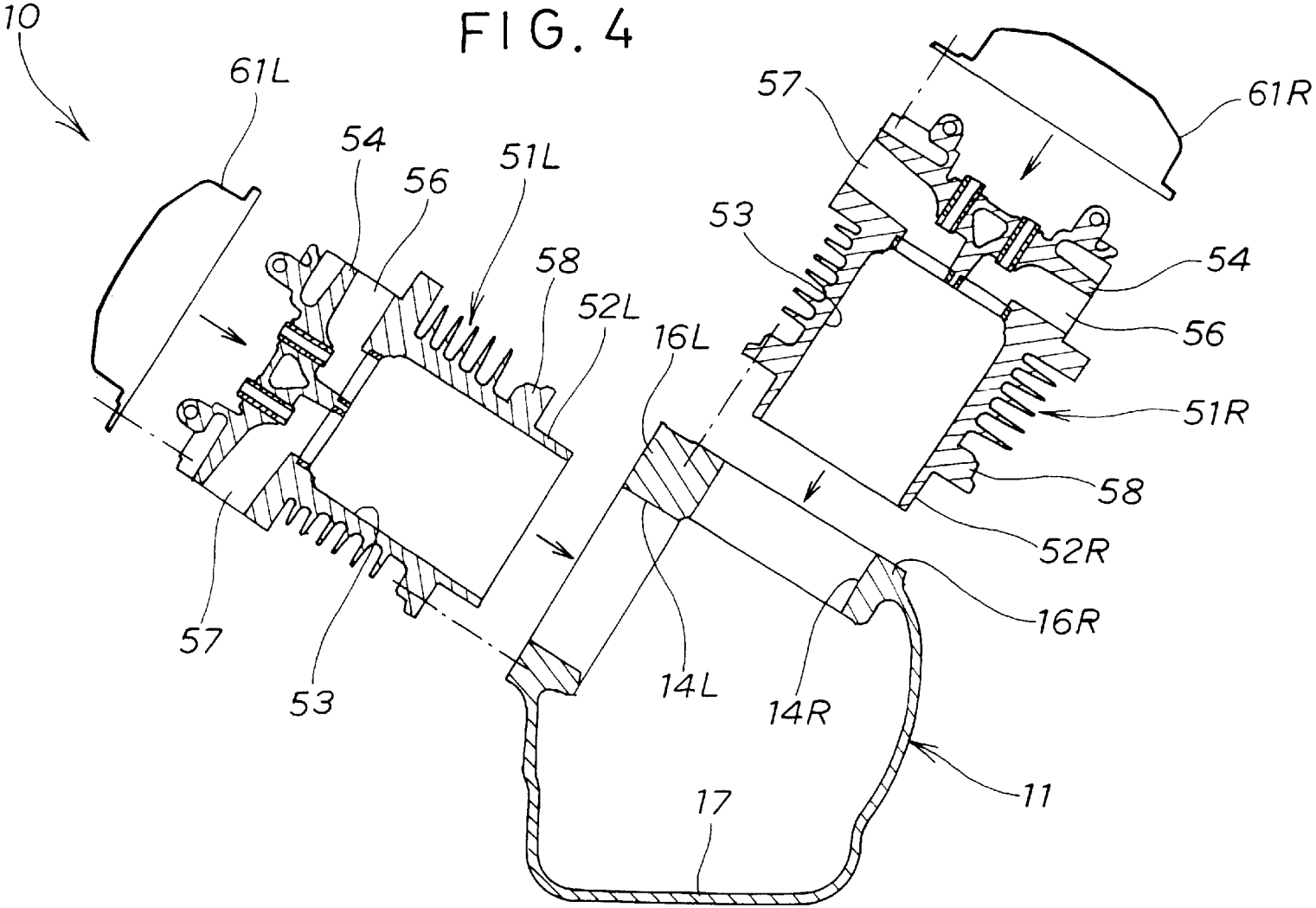
FIG. 4 is an exploded horizontal cross-sectional view of the OHC V-2 engine.

FIG. 4 illustrates the manner in which the cylinder blocks 51L, 51R, head covers 61L, 61R and crankcase 11 are assembled together.

As shown in FIG. 4, the mounting end 52L, 52R of each cylinder block 51L, 51R is fitted into a corresponding one of the mounting holes 14L, 14R of the crankcase 11 until a mounting flange 58 of the cylinder block 51L, 51R is in face to face contact with a mounting seat 16L, 16R of the crankcase 11. Then, the cylinder blocks 51L, 51R are firmly secured to the crankcase 11 by means of screws (not shown but identical to the screw 15 shown in FIG. 1). The head covers 61L, 61R are attached by screws (not shown) to the cylinder heads 54, 54 of the corresponding cylinder blocks 51L, 51R. Due to the connection using the threaded fasteners, the cylinder blocks 51L, 51R and the head covers 61L, 61R can be detached from the crankcase 11 and the cylinder blocks 51L, 51R, respectively, when the repair or replacement of the parts becomes necessary. Though not shown, a seal member, such as a liquid packing, is disposed between the mounting flanges 58 of the cylinder blocks 51L, 51R and the mounting seats 16L, 16R of the crankcase 11 to provide a hermetic seal therebetween.

Figure 5:
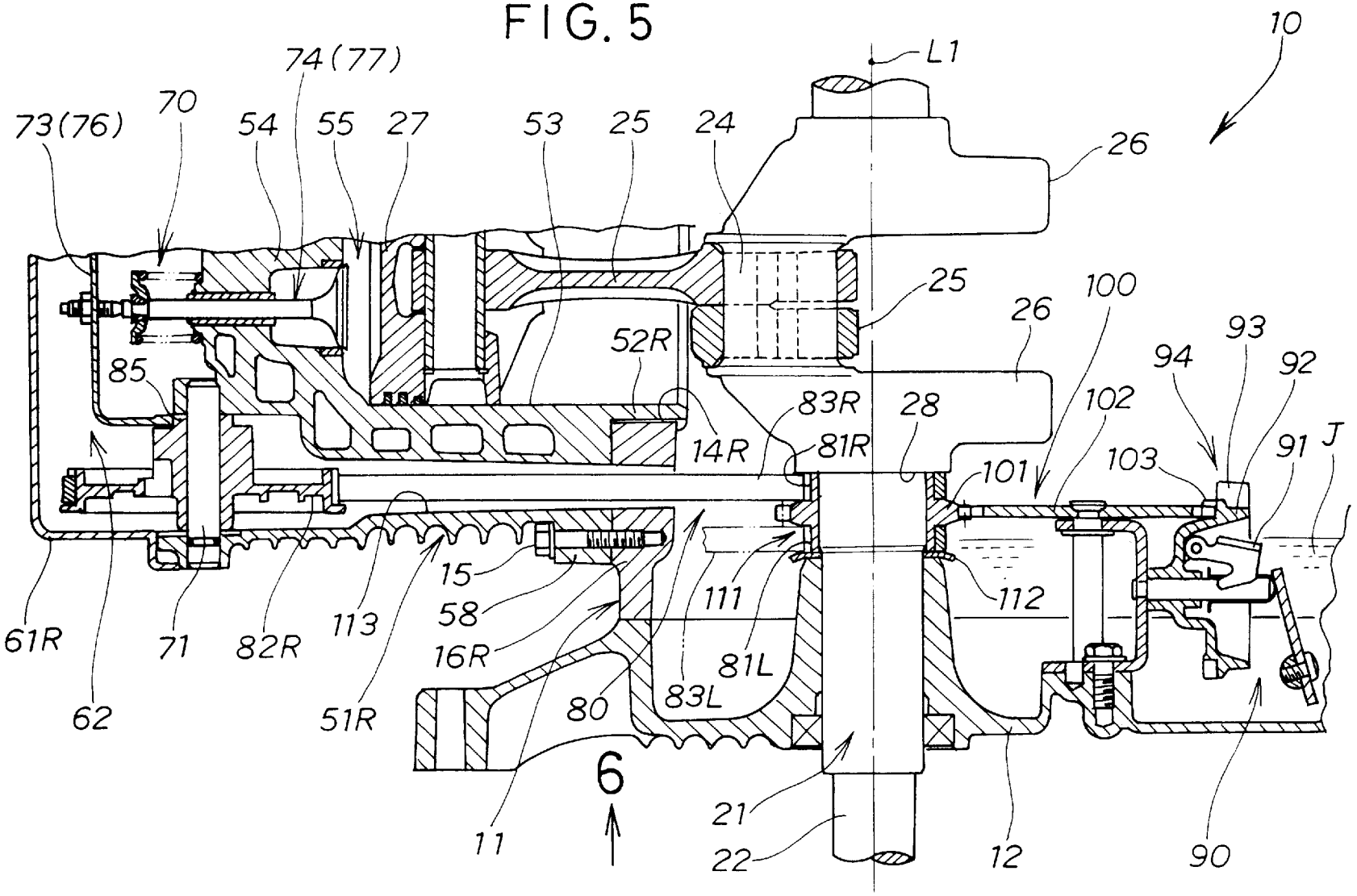
FIG. 5 is an enlarged view of a portion of FIG. 1.

Reference is next made to FIG. 5 which shows on enlarged scale a lower part of the OHC V-2 engine 10 shown in FIG. 1.

The engine 10 further comprises a power transmitting mechanism 80 for transmitting power from the crankshaft 21 to the camshafts 71 to thereby drive the valve mechanisms 70, and a centrifugal governor mechanism 90 is disposed in the crankcase 11 adjacent to the lid 21 for a purpose described below.

The camshaft 71 is rotatably supported by the cylinder head 54 of the right cylinder block 51R. A driven pulley 82R is connected to the camshaft 71 and has a cam 85 formed integrally with the driven pulley 82R. The cam 85 is held in driving engagement with the rocker arms 73, 76 of the intake and exhaust valves 74, 77 of the valve mechanism 70 so that when the cam 85 rotates about the axis of the camshaft 71 in response to rotation of the driven pulley 82R, the rocker arms 73, 75 are caused to rock or oscillate to thereby open and close the intake and exhaust valves 74, 77 with prescribed valve timing.

The description given just above with reference to FIG. 5 may be applied to a similar mechanism associated with the left cylinder block 51L.

Figure 6:
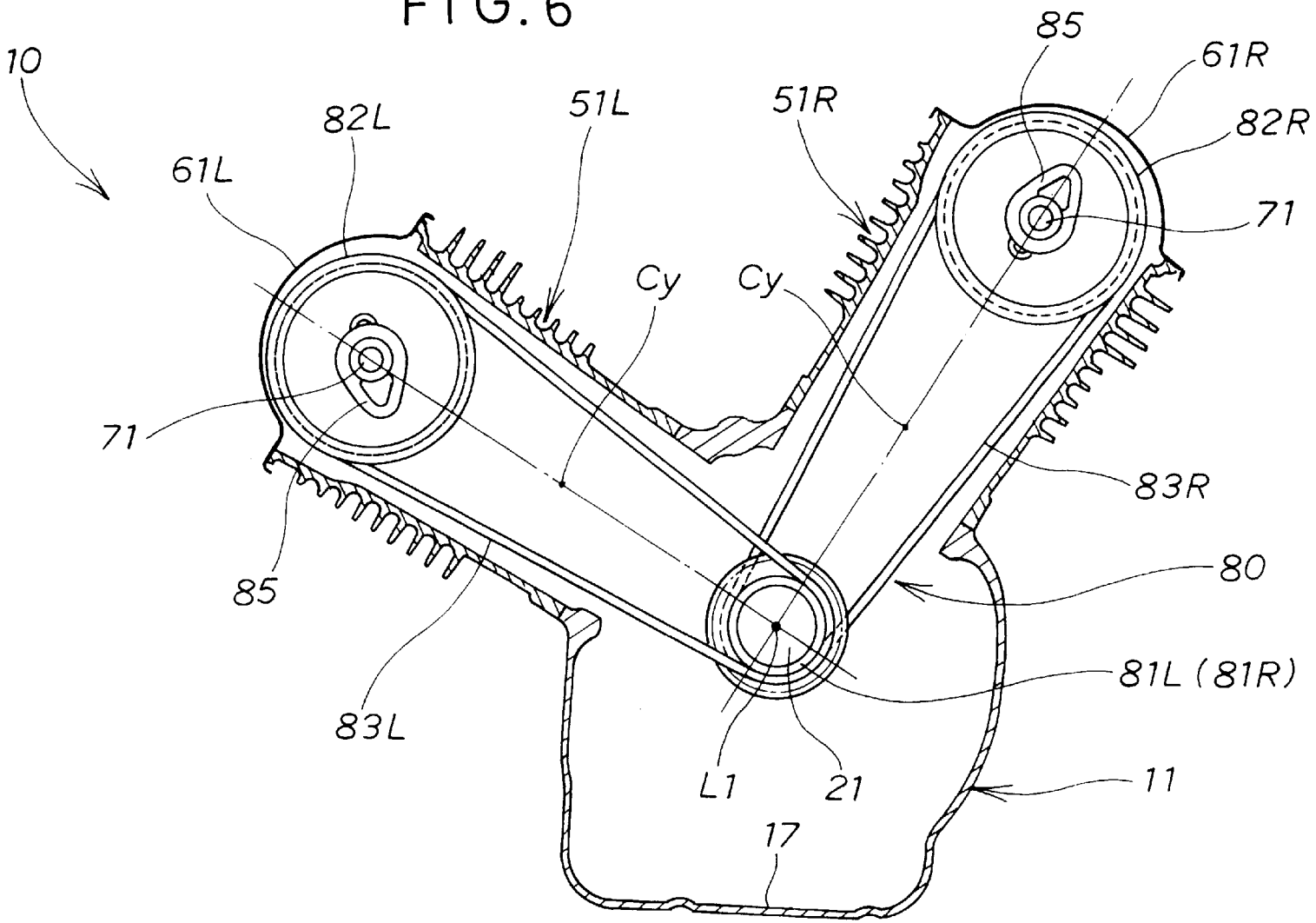
FIG. 6 is a horizontal cross-sectional view of the OHC V-2 engine, showing the general construction of a power transmitting mechanism for transmitting power from a crankshaft to camshafts of the engine.

As shown in FIG. 6, the power transmitting mechanism 80 comprises two identical driving pulleys 81L and 81R connected in tandem to the crankshaft 21 within the crankcase 11, two identical driven pulleys 82L, 82R connected to the camshafts 71 of the left and right cylinder blocks 51L, 51R, and two identical driving belts 83L, 83R each trained around one pair of driving and driven pulleys 81L and 82L; 81R and 82R. The driving belts 83L, 83R comprise a toothed timing belt, and the driving and driven pulleys 81L, 81R and 82L, 82R comprise a toothed pulley.

By using two timing belt drives of identical construction, the power transmitting mechanism 80 requires a smaller number of components to be produced and, hence, can be manufactured less costly.

Referring back to FIG. 5, the centrifugal governor mechanism 90 is actuated by the centrifugal force of a whirling weight 91 opposed by gravity or by a spring (not shown), and is used to control the engine speed by adjusting the amount of fuel to be injected from a fuel injection device (not shown) of the engine 10 on the basis of the rotational speed of the crankshaft 21.

The whirling weight 91 is pivotally connected to a cup-shaped rotating holder 92 rotatably mounted on a horizontal shaft (not designated) connected at one end to a vertical bracket (not designated) secured by screws (one being shown) to the lid 12 of the crankcase 11. Thus, the cup-shaped rotating holder 92 is rotatable about an axis perpendicular to the axis of the crankcase 21. The holder 92 has a plurality of circumferentially spaced oil splashing projections or slingers 93 (only one being shown) formed on the outer circumference thereof.

A lower part of the cup-shaped rotating holder 92 dips below a lubricating oil J held or collected at the bottom of the crankcase 11 so that when the cup-shaped rotating holder 92 is rotating by the rotational power of the crankshaft 21, the oil splashing projections 93 can continuously draw up the lubricating oil from the bottom of the crankcase 11 and subsequently splash the lubricating oil over the parts held inside the crankcase 11. The oil splashing projections 93 of the centrifugal governor mechanism 90 and the driving belts 83L, 83R of the power transmitting mechanism 80 jointly constitute a lubricating device or mechanism 94, as will be described later.

A governor driving mechanism 100 for rotatably driving the cup-shaped rotating holder 92 of the centrifugal governor mechanism 90 has a driving gear 101 attached to the crankshaft 21, an intermediate gear 102 meshing with the driving gear 101 and rotatably mounted on a vertical shaft (not designated) connected to the lid 12, and a driven gear 103 meshing with the intermediate gear 102 and formed on an end face of the cup-shaped rotating holder 92.

As shown in FIG. 5, the driving gear 101 of the governor driving mechanism 100 and the driving pulleys 81L, 81R of the power transmitting mechanism 80 are formed integrally with each other, and the driving pulley 81L, 82R are disposed on opposite sides of the driving gear 101. The driving gear 101 and the driving pulleys 81L, 81R jointly form an integrated driving member 111. The integrated driving member 111 is directly connected to the power take out portion 22 of the crankshaft 21. The driving pulleys 81L, 81R are both disposed on the same side (power take-out end side) of the crankshaft 21. Use of the integrated driving member 111 can reduce a number of structural components used and also can prevent lateral displacement or oscillation of the driving belts 83L, 83R trained around the corresponding driving pulleys 81L, 81R.

The pitch or distance between the two laterally spaced driving pulleys 81L and 81R is substantially equal to the pitch or distance between the two connecting rods 25, 25 arranged in tandem in the longitudinal direction of the crankshaft 21.

A ring-like belt guide 112 is mounted on the crankshaft 21 and disposed between the driving pulley 81L (i.e., one end of the integrated driving member 111) and a boss (not designated) of the lid 12 for slidably guiding an outside edge of the driving belt 83L. Similarly, the crank web 26 of the crankshaft 21 has a central boss 28 of enlarged diameter disposed in abutment with an end face of the driving pulley 81R (i.e., the opposite end of the integrated driving member 111) for slidably guiding an outside edge of the driving belt 83R. Respective inside edges of the driving belts 83L, 83R are guided by opposite end faces of the driving gear 101. Reference numeral 113 denotes a belt passageway provided in the cylinder block 51R for the passage of the driving belt 83R. Though not shown in FIG. 5, the cylinder head 51L has a similar belt passageways for the passage of the driving belt 83L.

Operation of the centrifugal governor mechanism 90 and lubricating mechanism 94 will be described with reference to FIG. 5.

A driving force or power of the crankshaft 21 is transmitted through a gear train composed of the driving gear 101, intermediate gear 102 and driven gear 103 to the cup-shaped rotating holder 92 whereby the holder 92 is rotated to achieve a prescribed operation for controlling the engine speed.

Rotation of the holder 92 causes the oil splashing projections 93 to revolve about the axis of the holder 92 so that the lubricating oil J is drawn up from the bottom of the crankcase 11 and subsequently splashed over the internal parts of the crankcase 11 by means of the revolving oil splashing projections 93. A part of the splashed oil may adhere to the driving belts 83 either directly or through the intervention of the driving gear 101 and the intermediate gear 102. The lubricating oil thus carried on the driving belts 83L, 83R in the form of oil droplets is conveyed toward the driven pulleys 82L, 82R, and when the driving belts 83L, 83R make a U-turn along the peripheries of the driven pulleys 82L, 82R, the lubricating oil is splashed from the driving belts 83L, 83R by the action of the centrifugal force. The splashed lubricating oil strikes on the inside surface of the head covers 61L, 61R and thereby forms an oil mist. The oil mist spreads over the valve chambers 62 and lubricates the moving parts of the valve mechanisms 70.

Thus, the lubricating mechanism 94 constituted by the oil splashing projections 93 and the driving belts 83L, 83R is able to guide the lubricating oil J from the bottom of the crankcase 11 to the moving parts of the valve mechanisms 70 and lubricate the moving parts without using a conventional separate lubricating system including an oil pump and oil passageways, such as disclosed in Japanese Utility Model Laid-open Publication No. HEI-2-24017. The lubricating mechanism 94 is simple in construction, is compact in size, can be manufactured less costly, and is able to downsize the OHC V-2 engine 10. In addition, since the oil splashing projections 93 are formed as an integral part of the centrifugal governor mechanism 90, the lubricating mechanism 94 has a relatively small number of structural components. This may add to the downsizing and cost reduction of the OHC V-2 engine 10.

Figure 7:
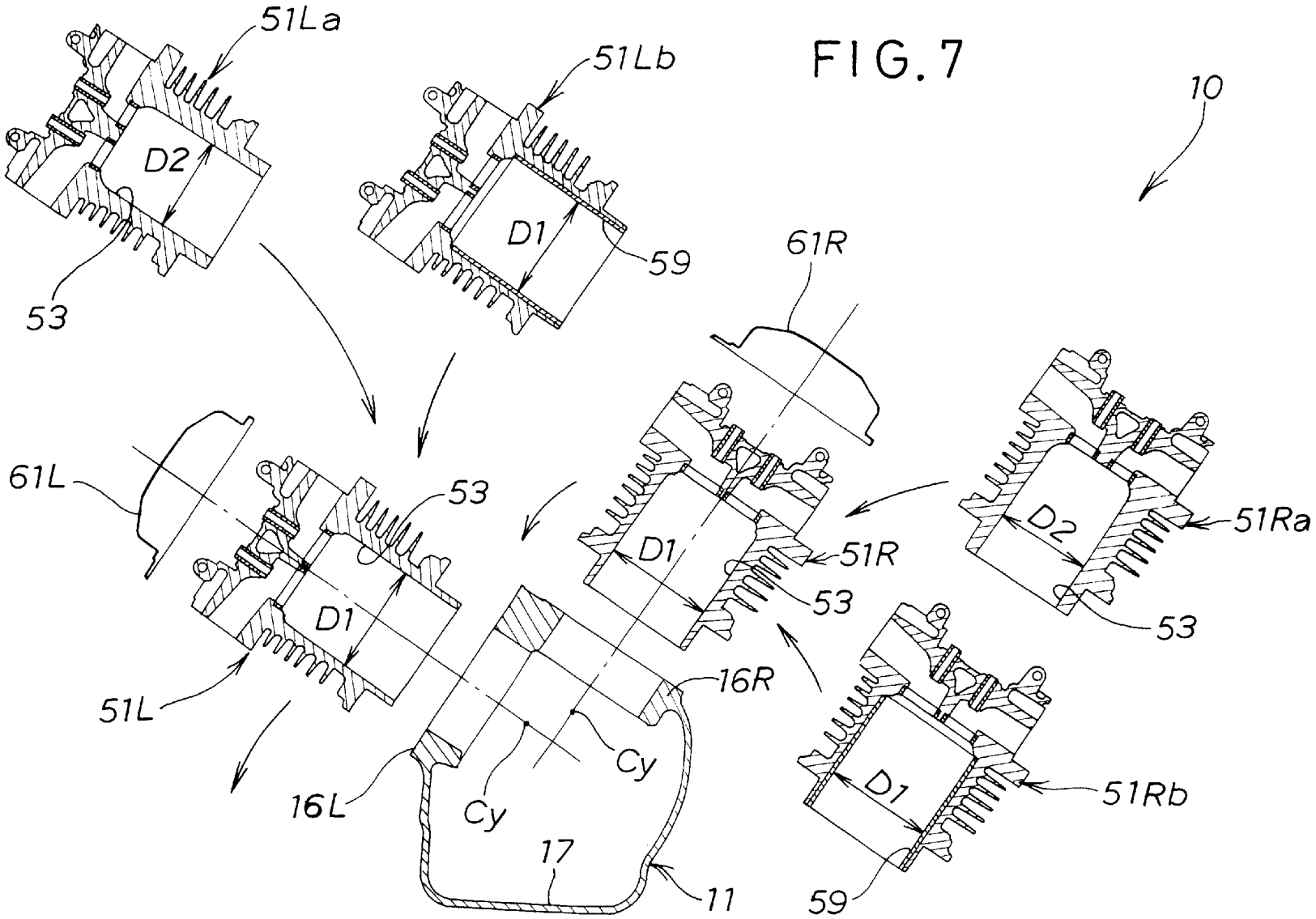
FIG. 7 is a view similar to FIG. 6, but showing the manner in which cylinder blocks of the engine can be replaced with cylinder blocks of a different size or structure.

FIG. 7 illustrates the manner in which the cylinder blocks 51L, 51R of the engine 10 can be replaced with cylinder blocks of a different size or structure.

The cylinder blocks 51L, 51R initially used in the engine 10 have a cylinder diameter D1. When a different engine displacement is desired, the cylinder blocks 51L, 51R may be replaced with cylinder blocks 51La, 51Ra having a different cylinder diameter D2. As an alternative, the cylinder blocks 51L, 51R may be replaced with cylinder blocks 51Lb, 51Rb equipped with a cylinder sleeve 59 having the same cylinder diameter D1 when a different cylinder structure is required. Though not shown, the cylinder blocks 51L, 51R may be replaced with cylinder blocks having a different length.

By thus replacing the cylinder blocks 51L, 51R, it becomes possible to produce various types of engines according to the usage or application. Apart from the replacement of the cylinder blocks 51L, 51R, the crankcase 11 and the head covers 61L, 61R are always used in common. This arrangement increases the productivity and lowers the equipment cost, leading to a substantial cost reduction of the engine 10. The replaceable cylinder blocks 51L, 51R are highly compatible because they can be used in common to a single cylinder engine and a multi-cylinder engine.

As shown in FIG. 5, there is no partition wall provided between the driving belts 83L, 83B and the crankcase 11. In addition, the driving pulleys 81L, 81R are disposed in tandem or close juxtaposition on the crankshaft 21. This arrangement makes it possible to reduce the size of the crankcase 11 and the length of the crankshaft 21, resulting in downsizing of the engine 10.

As shown in FIG. 1, the cooling fan 41 is attached to the upper end portion 23 of the crankshaft 21 which is opposite to the power take out portion of the crankshaft 21, and the driving pulleys 81L, 81R (FIG. 5) of the power transmitting mechanism 80 are attached to the power take out portion 22 of the crankshaft 21 for simultaneously driving the two camshafts 71 (FIG. 6). The power transmitting mechanism 80 for driving the two camshaft 71 is disposed on only one side of the crankcase 11. With this arrangement, the power transmitting mechanism 80 requires no extra space for installation thereof and hence can reduce the overall size of the engine 10. In addition, since the power transmitting mechanism 80 is accessible from one side of the engine 10, the assembly and maintenance of the power transmitting mechanism 80 can be achieved easily and efficiently.

The engine 10 can be used in general power-driven working machines, motorcycles, outboard motors, etc.

The cylinder blocks 51L, 51R should by no means be limited to the unitary structure having an integral cylinder head 54 as in the illustrated embodiment but may include a separate structure having a separate cylinder head.

The respective positions of the cylinder blocks 51L, 51R in the axial direction of the crankshaft 21 are interchangeable.

The power transmitting mechanism 80 constituted by a belt drive may be replaced with a chain drive in which instance the driving and driven pulleys 81L, 81R and 82L, 82R are replaced with driving and driven sprockets, and the driving belts 83L, 83R are replaced with driving chains.

Obviously, various minor changes and modifications of the present invention are possible in the light of the above teaching. It is therefore to be understood that within the scope of the appended claims, the present invention may be practiced otherwise than as specifically described.

What is claimed is:

1. An overhead camshaft V-2 engine comprising:

a crankcase;

a crankshaft rotatably supported in the crankcase;

two cylinder blocks each having one cylinder head and mounted to the crankcase such that the cylinder blocks are arranged at an angle to each other;

two valve mechanisms each mounted to the cylinder head of one of the cylinder blocks and having one camshaft; and a single power transmitting mechanism disposed on one side of the crankcase for transmitting rotational power from the crankshaft to the camshafts to drive the valve mechanisms, the power transmitting mechanism having a driving member mounted to only one end portion of the crankshaft; and two intake ports one formed in each of the respective cylinder heads of the cylinder blocks and opening at one end to respective first surfaces of the cylinder heads facing in a first direction, and two exhaust ports one formed in each of the respective cylinder heads of the cylinder blocks and opening at one end to respective second surfaces of the cylinder heads facing in a second direction opposite to the first direction.

2. An overhead camshaft V-2 engine according to claim 1, wherein the driving member of the power transmitting mechanism includes a pair of driving pulleys mounted in tandem on the crankshaft.

3. An overhead camshaft V-2 engine according to claim 2, wherein the crankshaft has a single offset crankpin, the engine further comprises two connecting rods attached side by side to the crankpin, and the distance between the pair of driving pulleys is substantially equal to the distance between the two connecting rods.

4. An overhead camshaft V-2 engine 3, wherein the power transmitting mechanism further comprises a pair of driven pulleys connected to the respective camshafts of the valve mechanisms, and a pair of driving belts each trained around one of the driving pulleys and a corresponding one of the driven pulleys.

5. An overhead camshaft V-2 engine 4, wherein the crankshaft has a boss of an enlarged diameter held in abutment with an end face of one of the driving pulleys and slidably engageable with an outside edge of one of the driving belts for guiding the one driving belt, and the engine further comprises a ring-like belt guide mounted on the crankshaft and disposed between an end face of the other driving pulley and a portion of the crankcase, the belt guide being slidably engageable with an outside edge of the other driving belt for guiding the other belt.

6. An overhead camshaft V-2 engine according to claim 1, further comprising a centrifugal governor mechanism disposed in the crankcase for controlling rotational speed of the engine, the governor mechanism having a generally cup-shaped holder rotatably driven by the crankshaft and being partly dipped below a lubricating oil held at a bottom of the crankcase, and a lubricating mechanism for lubricating movable parts of the engine, the lubricating mechanism having a plurality of circumferentially spaced oil splashing projections formed on an outer peripheral surface of the cup-shaped holder so that when the cup-shaped holder is rotating by the rotational power of the crankshaft, the oil splashing projections continuously revolve about an axis of rotation of the cup-shaped holder to thereby draw up the lubricating oil from the bottom of the crankcase and splash the lubricating oil over at least a part of the power transmitting mechanism.

7. An overhead camshaft V-2 engine according to claim 6, wherein the power transmitting mechanism further has a pair of driving sprockets formed integrally with the driving member and spaced in the axial direction of the crankshaft, a pair of driven pulleys connected to the respective camshafts of the valve mechanisms, and a pair of driving belts each trained around one of the driving pulleys and a corresponding one of the driven pulleys, the driving chains forming part of the lubricating mechanism and being capable of guiding the lubricating oil into the valve mechanisms.

8. An overhead camshaft V-2 engine according to claim 7, wherein the governor mechanism further has a driving gear formed integrally with the driving member and disposed between the pair of driving pulleys, the driving gear being connected in driving relation to the cup-shaped holder for rotating the holder.

9. An overhead camshaft V-2 engine according to claim 1, further comprising a cooling fan mounted to the opposite end portion of the crankshaft.

* * * * *